US012733754B2

(12) United States Patent
Chen

(10) Patent No.: US 12,733,754 B2
(45) Date of Patent: Sep. 15, 2026

(54) CASCADE DISPLAY RACK AND PACKAGE METHOD AND INSTALLATION METHOD THEREOF

(71) Applicant: SHANGHAI YAOKUNBIAO TECHNOLOGY EQUIPMENT CO., LTD., Shanghai (CN)

(72) Inventor: Qiang Chen, Shanghai (CN)

(73) Assignee: SHANGHAI YAOKUNBIAO TECHNOLOGY EQUIPMENT CO., LTD., Shanghai (CN)

( * ) Notice: Subject to any disclaimer, the term of this patent is extended or adjusted under 35 U.S.C. 154(b) by 225 days.

(21) Appl. No.: 18/658,970

(22) Filed: May 8, 2024

(65) Prior Publication Data

US 2025/0344881 A1 Nov. 13, 2025

(51) Int. Cl.

| | |
|---|---|
| ***A47F 5/00*** | (2006.01) |
| ***B65B 5/04*** | (2006.01) |
| ***B65B 55/00*** | (2006.01) |

(52) U.S. Cl.

CPC ..... *A47F 5/0018* (2013.01); *B65B 5/04* (2013.01); *B65B 55/00* (2013.01)

(58) Field of Classification Search

CPC ..... A47F 5/0018; A47F 3/001; B65B 5/04; B65B 55/00

See application file for complete search history.

(56) References Cited

U.S. PATENT DOCUMENTS 1,125,194 A * 1/1915 Sigmund ..... A47F 5/112 108/100
1,320,310 A * 10/1919 Brady ..... A47F 5/112 108/100
1,514,055 A * 11/1924 Lawson ..... A47F 5/108 108/100
1,580,061 A * 4/1926 Lund ..... A47F 5/108 108/100
1,594,754 A * 8/1926 Reines ..... A47F 7/145 108/61
1,713,908 A * 5/1929 Moses ..... A47F 5/10 211/128.1
1,745,164 A * 1/1930 Griffith ..... A47F 7/28 108/23
1,848,214 A * 3/1932 Brown ..... A47F 7/0071 211/128.1
1,955,370 A * 4/1934 Snook ..... A47F 5/0018 211/128.1
3,564,790 A * 2/1971 Rehfeld ..... E04F 11/06 108/92

(Continued)

*Primary Examiner* — Stanton L Krycinski
(74) *Attorney, Agent, or Firm* — Hawaii Patent Services; Nathaniel K. Fedde; Kenton N. Fedde

(57) ABSTRACT

A cascade display rack and package method and installation method thereof, comprising: a first assembly, comprising a plurality of cascade plates forming a cascade, and a plurality of light band plates detachably connected on the plurality of cascade plates; a second assembly, comprising a back panel, and a first side panel and a second side panel rotatably provided at both ends of the back panel; a plurality of erecting panels are provided at both ends of the plurality of cascade plates in the first assembly, the first side panel and the second side panel are fixable on the plurality of erecting panels to connect the first assembly and the second assembly.

10 Claims, 11 Drawing Sheets

(56) References Cited

U.S. PATENT DOCUMENTS 4,689,726 A * 8/1987 Kretzschmar ..... F21S 4/20 362/127
4,985,095 A * 1/1991 Riddle ..... E04F 11/163 156/71
5,205,638 A * 4/1993 Squitieri ..... A47F 11/10 312/223.5
5,357,876 A * 10/1994 Kniefel ..... E04H 3/12 108/92
5,570,540 A * 11/1996 Womack ..... A47G 7/041 47/60
5,692,445 A * 12/1997 Winer ..... A47F 5/16 108/100
6,105,796 A * 8/2000 Buchanan ..... A47F 5/116 186/59
6,231,205 B1 * 5/2001 Slesinger ..... A47B 97/00 362/225
6,283,608 B1 * 9/2001 Straat ..... F21S 8/00 362/127
6,438,909 B2 * 8/2002 Birch ..... E04F 11/00 52/177
6,918,679 B2 * 7/2005 Wu ..... G09F 13/04 362/132
7,012,218 B2 * 3/2006 Flinn ..... A47F 3/001 219/400
7,614,350 B2 * 11/2009 Tuttle ..... A47B 97/00 108/50.02
8,135,482 B2 * 3/2012 Caldwell ..... G09F 3/204 211/119.003
8,701,830 B2 * 4/2014 Merey ..... E06C 1/383 108/92
8,979,296 B2 * 3/2015 Wiemer ..... F21V 23/001 362/125
9,408,480 B2 * 8/2016 O'Toole ..... A47F 7/021
9,596,950 B2 * 3/2017 Waalkes ..... F21V 23/06
9,775,447 B2 * 10/2017 Wiemer ..... A47F 5/103
10,172,484 B2 * 1/2019 Maldonado ..... A47F 7/06
10,362,886 B2 * 7/2019 Bellar ..... A47F 5/0062
11,109,677 B2 * 9/2021 Adams ..... G09F 13/10
11,266,255 B1 * 3/2022 Johnson ..... A47F 7/0078
11,503,925 B1 * 11/2022 Walker ..... A47F 3/001
D977,308 S * 2/2023 Chen ..... D7/600.4
11,759,993 B2 * 9/2023 Ringel ..... B29C 51/08 264/552
11,779,132 B2 * 10/2023 McMillin ..... F25D 25/02 362/125
11,903,498 B1 * 2/2024 Walker ..... G09F 9/35
12,044,464 B2 * 7/2024 McMillin ..... F25D 27/00
2006/0261023 A1 * 11/2006 Goth ..... A47F 7/145 211/128.1
2011/0044030 A1 * 2/2011 Pichel ..... F21S 4/28 362/125
2013/0299439 A1 * 11/2013 Sid ..... A47F 11/10 211/134
2019/0298083 A1 * 10/2019 Lee ..... F21V 21/35
2021/0023765 A1 * 1/2021 Ringel ..... F21S 4/20

* cited by examiner

CASCADE DISPLAY RACK AND PACKAGE METHOD AND INSTALLATION METHOD THEREOF

TECHNICAL FIELD

The present invention relates to the technical field of display racks, especially a cascade display rack and package method and installation method thereof.

BACKGROUND TECHNOLOGY

In the prior art, cascade display racks are usually used in bars, hotels, etc., and the cascading supporting structures thereof can be used to place wines, wine glasses for exhibition. In specific conditions, light admitting materials are used for surfaces of the display racks where objects are placed, and lights are provided inside to improve visual appearances and exhibition functions of the display racks.

However, the cascade display racks in the prior art usually have multiple steps or are long, so as to place and support more wines and enhance display effects. Display racks of larger sizes usually require thicker protection pads and corresponding packaging boxes, consequently, transportation space occupied by the larger sized display racks after packaging is a lot, and transportation cost for a single display rack is high. Actually, for common usage circumstances of display racks, the display racks are used in a small quantity, therefore, the display racks cannot be packaged and transported in large quantities, making it next to impossible to transport the display racks in large quantities to reduce transportation cost.

Further, in international trades, manufacturing of display racks is usually done in a country C with a lower cost, however, where the display racks are indeed used is a country A with a flourishing wine culture, as a result, the display racks are to be transported overseas, at this time, transportation expenses generated due to small quantity transportation of large sized packaged volumes of the display racks makes up a large part of the cost of the display racks, which makes the display racks less competitive.

SUMMARY OF THE INVENTION

The present invention aims to solve the problem of how to reduce the transportation cost of the cascade display racks without influencing selling of the cascade display racks. To this end, the present invention provides a cascade display rack, by separating the display rack into a plurality of parts that can be assembled together and configuring positions of each of the plurality of parts during transportation to be adjustable, volumes of the display racks during transportation are reduced to a great extent; in the meanwhile, the parts of the display rack are reasonably divided so that consumers can easily assemble the display rack together, and the assembled display rack can maintain a sufficient structural strength to support articles for display.

An embodiment of the present invention provides a cascade display rack, comprising:

A first assembly, comprising a plurality of cascade plates forming a cascade, and a plurality of light band plates detachably connected on the plurality of cascade plates;

The plurality of cascade plates comprise a plurality of supporting plates and a plurality of vertical plates, wherein the plurality of supporting plates and the plurality of vertical plates are alternately connected;

Wherein the plurality of supporting plates comprise light-admitting plates, the plurality of vertical plates comprise light screen plates, and the plurality of light band plates are provided corresponding to the plurality of supporting plates;

A second assembly, comprising a back panel, and a first side panel and a second side panel rotatably provided at both ends of the back panel;

A plurality of erecting panels are provided at both ends of the plurality of cascade plates in the first assembly, the first side panel and the second side panel are fixable on the plurality of erecting panels to connect the first assembly and the second assembly.

With the foregoing technical solution, the entire display rack is separated to be a first assembly and a second assembly, on one aspect, a number of parts for separation is reduced, assembly complexity and difficulty can be reduced, on the other aspect, the first assembly comprises a plurality of cascade plates and a plurality of light band plates detachably connected on the plurality of cascade plates, consequently, the plurality of cascade plates can be changed from placing diagonally to be placing transversely, so that by increasing the width slightly, the height of the product can be reduced to a large extent. The second assembly comprises a back panel and a first side panel and a second side panel rotatably connected at both ends of the back panel, so that the first side panel and the second side panel are foldable relative to the back panel, a large isometric structure is folded to be planar structures, and can be stacked on the first assembly, in this way, the volume of the display rack during transportation is reduced significantly.

In some embodiment, at least one first engagement assembly is provided on the plurality of cascade plates, and the at least one first engagement assembly is configured to install the plurality of light band plates; at least one first engagement bulge is provided on the plurality of light band plates;

The at least one first engagement assembly comprises at least one limiting groove, and at least one first buckle intermittently provided next to the at least one first limiting groove;

The at least one first buckle is configured to be connected with the at least one first engagement bulge on the plurality of light band plates, and the at least one first limiting groove is configured to house edges of the plurality of light band plates away from the at least one first engagement bulge.

In some embodiments, the plurality of light band plates comprise a plurality of cascade light band plates and at least one top-layer light band plate; and the plurality of supporting plates comprise at least one top-layer supporting plate and at least one non-top-layer supporting plate;

The at least one top-layer supporting plate is configured to be at least one first light reflective plate, and is provided opposite to the at least one top-layer supporting plate of the plurality of cascade plates, and at least one light reflective film and at least one light band are provided at a surface of the at least one first light reflective plate orienting to the at least one top-layer supporting plate;

The plurality of cascade light band plates comprise at least one second light reflective plate and at least one connection plate vertically connected, a light reflective space is formed by engagement of the plurality of cascade light band plates and the corresponding at least one non-top-layer supporting plate, and a light reflective film and a light band are provided on a surface of the at least one second light reflective plate orienting to the at least one non-top-layer supporting plate.

In some embodiments, at least one limiting groove is provided in the plurality of cascade plates, and at least one limiting block corresponding to the at least one limiting groove is provided on the back panel of the second assembly;

The at least one limiting groove and the at least one limiting block are configured to support the top-layer light band plate;

At least one second engagement assembly is provided on the plurality of cascade plates, the at least one second engagement assembly comprises at least one second limiting groove, and at least one second engagement buckle provided at an interval from the at least one second limiting groove;

At least one second engagement bulge for engagement with the at least one second engagement buckle is provided on the at least one connection plate of the plurality of cascade light band plates;

The at least one second engagement buckle is connected with the at least one second engagement bugle, and the at least one second limiting groove is configured to house edges of sides the at least one non-top-layer light band plate opposite to the at least one second limiting groove to support the at least one non-top-layer supporting plate.

In some embodiments, the present invention further comprises an energizing circuit, wherein the energizing circuit comprises a plurality of ports, controllers and power connectors sequentially connected; wherein the plurality of ports are connected with power supply plugs are of the plurality of light bands.

In some embodiments, a first connection region and a second connection region are provided at both ends of the plurality of cascade plates; The plurality of erecting panels are vertically provided at both ends of the plurality of cascade plates, and erecting positions of the plurality of erecting panels are connected with edges of the first connection region and the second connection region;

At least one positioning hole is provided in the plurality of erecting panels;

At least one limiting part corresponding to the at least one positioning hole in the plurality of erecting panels is provided on the first side panel and the second side panel;

The first side panel and the second side panel are connected with the at least one positioning hole in the plurality of erecting panels via the at least one limiting part, so that some edges of the first side panel are connected with the first connection region of the plurality of cascade plates, and some edges of the second side panel are connected with the second connection region of the plurality of cascade plates.

In some embodiments, fixing plates are provided at a top portion of the back panel of the second assembly, wherein the fixing plates pass a plurality of fixing holes in the back panel;

A plurality of hanging holes are provided in the fixing plates;

Both the first side panel and the second side panel are rotatably connected with the back panel via hinges, and rotation ranges of the first side panel and the second side panel relative to the back panel are 0-90°.

In some embodiments, the present invention further comprises a bottom panel covering the first assembly and the second assembly;

Edges of the bottom panel are connected with bottom edges of the first assembly and the second assembly, and wiring holes and a plurality of glass hanging holes are provided in the bottom panel.

In some embodiments, the plurality of supporting plates, the plurality of vertical plates, the bottom panel, the first side panel and the second side panel are made of acrylic materials.

The present invention further provides a packaging method of the cascade display rack, comprising the cascade display rack set forth in any of the foregoing embodiments; and a plurality of cushioning pads;

Wherein the plurality of cushioning pads comprise end portion cushioning parts and intermediate cushioning parts;

Cascading grooves are provided in the end portion cushioning parts, first installation notches are provided at edges of the end portion cushioning parts surrounding the cascading grooves, and an extension direction of the first installation notches is parallel to an extension direction of the cascading grooves;

Cascading through-holes are provided in the intermediate cushioning parts, and second installation notches are provided along edges of the cascading through-holes in the intermediate cushioning part;

The cascading grooves and the cascading through-hole are configured to enclose the first assembly; the first installation notches and the second installation notches are configured to place the second assembly when folded;

Wherein the packaging steps comprise:

S11: fitting the intermediate cushioning parts in the first assembly;

S12: connecting the end portion cushioning parts at both ends of the first assembly;

S13: placing the folded second assembly in between the first installation notches and the second installation notches;

S14: covering the second assembly with the cushioning pads;

S15: encasing to complete packaging and forming a part ready for transportation.

With the foregoing technical solutions, on one aspect, with the plurality of cushioning pads the first assembly and the second assembly can be effectively protected; on another aspect, by reasonably designing packaging of the first assembly and the second assembly, a volume of the entire packaged display rack ready for transportation is greatly reduced, the transportation cost is reduced; in the meanwhile, by folding the second assembly, the impact resistance of the second assembly is improved, in this way, the thickness of the cushioning pads can be reduced, and the volume of the packaged display rack can be further reduced.

The present invention provides an installation method of cascade display rack, comprising the packaged display rack ready for transportation;

Wherein the installation steps comprise:

S21: removing the packaging box, and removing the plurality of cushioning pads;

S22: placing the plurality of cascade plates upside down, and installing the plurality of light band plates sequentially;

S23: expanding the first side panel and the second side panel in the second assembly, and fixing the first side panel and the second side panel on the plurality of erecting panels of the plurality of cascade plates;

S24: putting the display rack in position and completing installation.

With the foregoing technical solutions, quick installation of the display rack can be done, in the meanwhile, the erected display rack has sufficient structural strength to satisfy actual usage requirements.

Other features and corresponding beneficial effects of the present invention will be elaborated on in the subsequent paragraphs of the specification and it shall be understood that, at least some beneficial effects become obvious from the recitation in the description.

Figure 1:
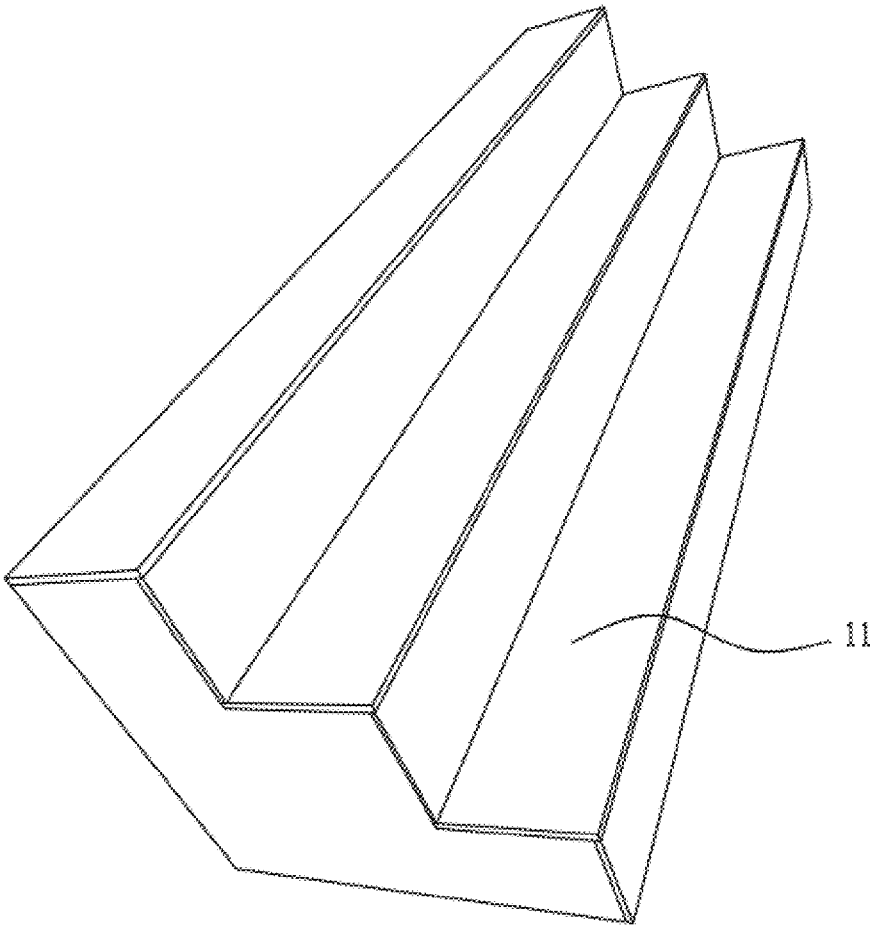
FIG. 1 is a structural perspective diagram showing a cascade display rack according to an embodiment of the present invention.

1 first assembly;
11 cascade plate;
111 supporting plate;
1111 top-layer supporting plate; 1112 non-top-layer supporting plate;
112 vertical plate;
12 light band plate;
121 cascade light band plate; 122 top-layer light band plate; 123 light band;
13 second engagement assembly;
131 second buckle; 132 second engagement bugle; 133 second limiting groove;
141 limiting block; 142 limiting groove;
15 erecting panel; 151 positioning hole;
16 first connection region;
17 second connection region;
2 second assembly;
21 back panel;
212 hanging hole; 213 fixing panel;
22 first side panel; 221 return resistance buckle;
23 second side panel;
24 hinge;
3 bottom panel;
31 glass hanging hole; 32 wiring hole;
4 cushioning part; and
5 cascade through-hole.

EMBODIMENTS

Hereinafter specific embodiments will be used to explain the way to carry out the present invention, and those skilled in the art will readily understand other advantages and technical effects of the present invention in view of the disclosure. Although the present invention is explained by introducing the preferred embodiment, this does not mean that the features of the present invention are limited to the embodiment.

In opposite, to explain the present invention in conjunction with the embodiments aims to cover other choices or improvements that may be extended based on the claims of the present invention. To give a deep understanding of the present invention, in the following description, numerous specific details are to be set forth. It is possible for the present invention not to use the details. In addition, to avoid confusion or departing from the emphasis of the present invention, some specific details will be omitted in the description. It shall be noted that, the embodiments and features in the embodiments can be combined with each other where no conflict will occur.

It shall be noted that, in the present invention, similar numerical marks and letters are given in the following drawings to represent similar features, therefore, once a feature is defined in a drawing, no further definition or explanation will be given thereto in the following drawings. Hereinafter a clear and complete description will be given to the technical solutions of the present invention, apparently, the embodiments given here are only some of the embodiments rather than all embodiments of the present invention. Based on the embodiments of the present invention, all other embodiments obtained by those of ordinary skill in the art without making creative effort fall into the protection scope of the present invention.

In the description of the present invention, positional or directional relationships indicated by terms "central", "upper", "lower", "left", "right", "vertical", "horizontal", "inner", "outer" etc. are positional or directional relationships based on the drawings, and are employed to make it convenient to describe the present invention and ease description, rather than to indicate or imply that the device or element must have a specific direction, be manufactured and operated in a specific direction, and shall not be construed as limitation on the present invention. Furthermore, terms "first", "second", "third" are used for the purpose of description, and shall not be understood as indicating or implying relative importance or implying a quantity of the technical feature. Therefore, a technical feature limited by "first", "second" can be one or more such feature implicitly or explicitly. In the description of the present invention, unless indicated otherwise, "a plurality of" means two or more.

In the description of the present invention, it shall be noted that, unless specified and limited otherwise "installation", "connection", "connected" shall be understood in broad sense, for example, the connection can be fixed connection or detachable connection or integral connection; can be mechanical connection or electrical connection; the connection can be direct connection or indirect connection via an intermediate medium or internal communication of two components. For those of ordinary skill in the art, specific contents of the terms in the present invention can be comprehensible in specific conditions.

To make the purpose, the technical solutions and the advantages of the present invention more clear, hereinafter a further detailed description will be given to the drawings in combination with embodiments of the present invention.

It shall be noted that, the cascade display rack comprises a plurality of cascade plates 11, a first side panel 22 and a second side panel 23 provided at both ends of the plurality of cascade plates 11; wherein the plurality of cascade plates 11 are configured to support articles such as wine glasses for exhibition, the first side panel 22 and the second side panel 23 are configured to support the plurality of cascade plates 11 to maintain the cascade plates properly supported; a back panel 21 is configured to support the first side panel 22 and the second side panel 23, to avoid deformation of the first side panel 22 and the second side panel 23 when being subjected to lateral forces and imbalance of the display rack; in the meanwhile, at least one installation holes are provided in the back panel 21 so that the display rack can be suspended on a wall via the back panel 21.

At this time, a package volume of the cascade display rack during transportation is correlated to a length of the display rack and a cross section thereof; further, to avoid damage due to collision during transportation, cushioning layers of a certain thickness are to be filled in between the display rack and the packaging box; wherein, the thickness of the cushioning layers are correlated to a shock strength of the display rack and the packaging box (that is, the higher the shock strength is, the smaller the thickness is required).

At this time, the package volume during transportation is correlated to the thickness of the cushioning layers, the length of the display rack and the cross section thereof.

When the display rack ready to be used is to be transported as the display rack is hollow inside, the surfaces of the display rack lack supports, therefore, during transportation, thicker cushioning layers are to be used for packaging, further still, the cross section of the display rack resembles a triangle in entirety, and a large number of the space of the cross section is wasted.

Figure 2:
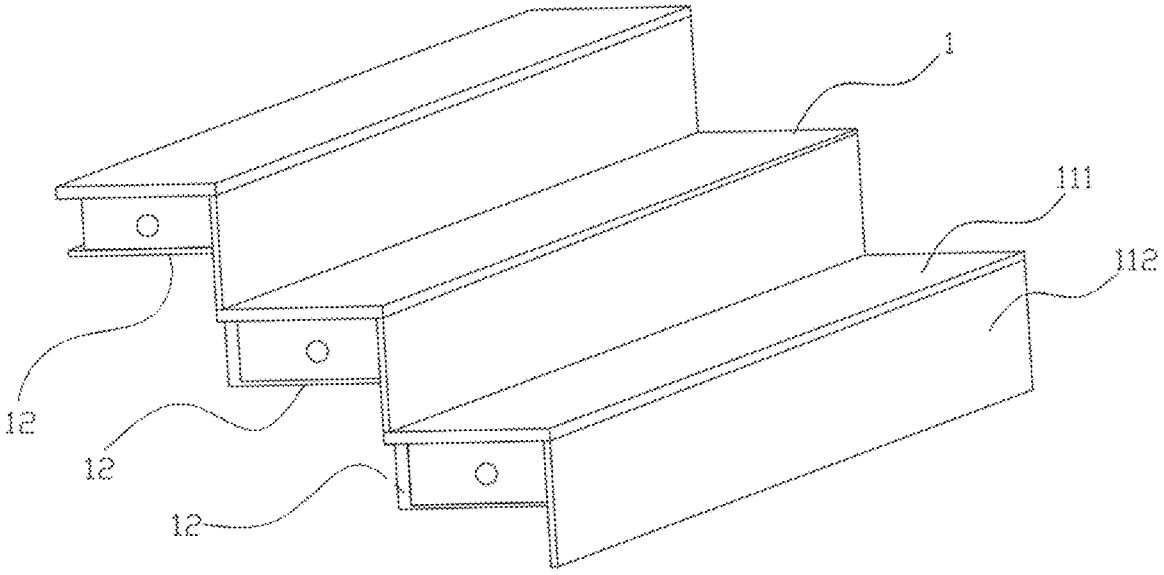
FIG. 2 is a structural perspective diagram in a first angle of view showing a first assembly of the cascade display rack according to an embodiment of the present invention.
Figure 3:
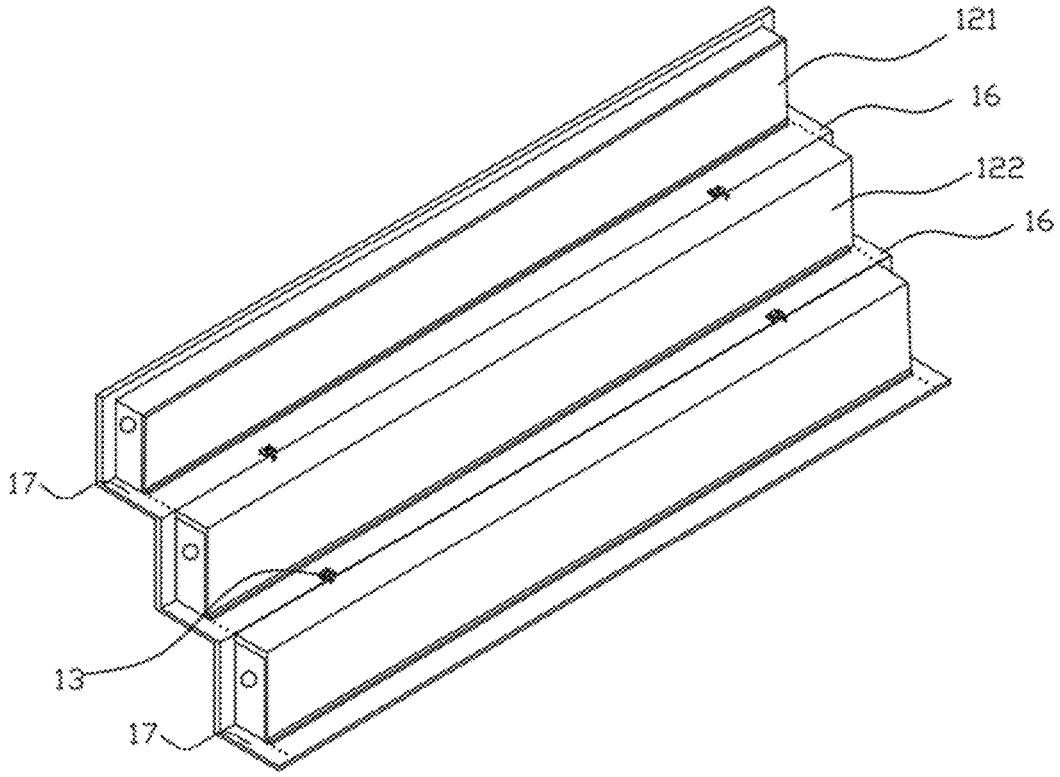
FIG. 3 is a structural perspective diagram in a second angle of view showing the first assembly of the cascade display rack according to an embodiment of the present invention.

With reference to FIGS. 1-3, FIG. 1 is a structural perspective diagram showing a cascade display rack provided in an embodiment of the present invention; FIG. 2 is a perspective diagram showing a first assembly of the cascade display rack provided in an embodiment of the present invention; FIG. 3 is a structural perspective diagram in a first angle of view of a second assembly of the cascade display rack provided in an embodiment of the present invention;

As shown in FIGS. 1-3, an embodiment of the present invention provides a cascade display rack, comprising:

A first assembly 1, comprising cascade plates 11 forming a cascade, and light band plates 12 detachably connected on the cascade plates 11;

The cascade plates 11 comprises supporting plates 111 and vertical plates 112, and the supporting plates 111 and the vertical plates 112 are alternately connected;

The supporting plates 111 are configured to be light-admitting plates, the vertical plates 112 are configured to be light screen plates, and the light band plates 12 are provided corresponding to the supporting plates 111;

A second assembly 2, comprising a back panel 21, and a first side panel 22 and a second side panel 23 rotatably provided at both end of back panel 21;

Erecting panels 15 are provided at both ends of the cascade plates 11 of the first assembly 1, the first side panel 22 and the second side panel 23 can be fixedly connected on the erecting panels 15 so as to connect the first assembly 1 and the second assembly 2.

Wherein, by separating the entire display rack to be the first assembly 1 and the second assembly 2, on one aspect, a number of detached components is reduced, assembly difficulty and complexity can be reduced. On the other aspect, the first assembly 1 comprises the cascade plates 11 and the light band plates 12 detachably connected on the cascade plates 11, so that the cascade plates 11 can be changed from diagonal placement to transverse placement, so that by increasing the width slightly, the packaged height of the product is greatly reduced. Further, by placing the cascade plates 11 transversely open areas generated can be used to place the light band plates 12, the transportation size of the first assembly can be reduced to the largest extent; the second assembly 2 is configured to be the back panel 21 and the first side panel 22 and the second side panel 23 rotatably provided at both ends of the back panel 21, so that the first side panel 22 and the second side panel 23 are foldable relative to the back panel 21, a larger size isometric structure is folded to be a planar structure, and can be stacked on the first assembly 1. In this way, the transportation volume of the display rack is reduced significantly.

Figure 12:
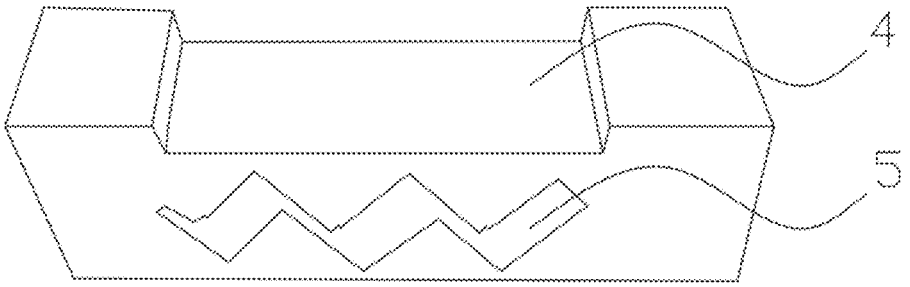
FIG. 12 is a structural perspective diagram showing a cushioning part according to an embodiment of the present invention.
Figure 13:
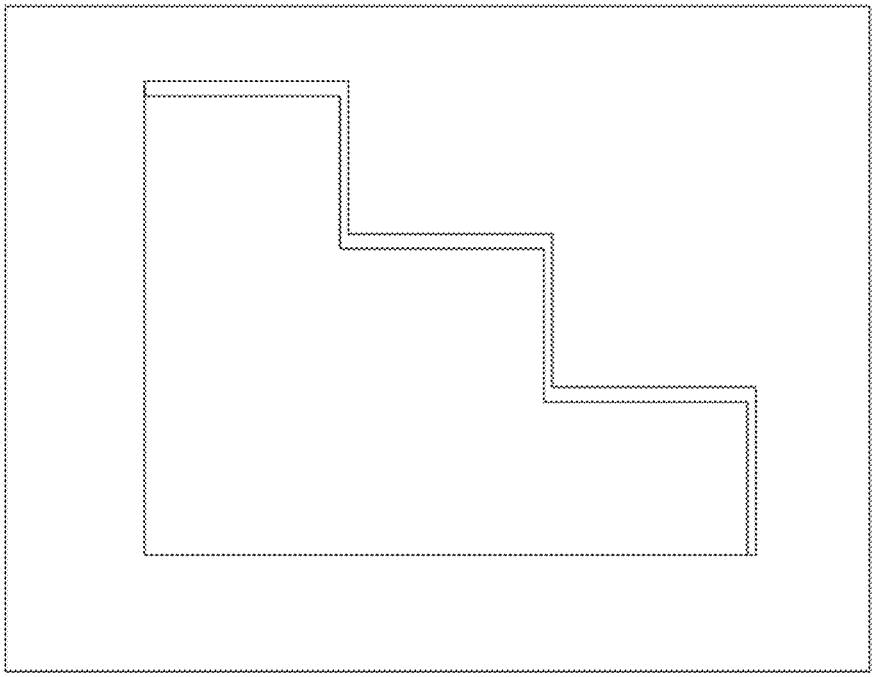
FIG. 13 is a structural diagram showing space required for packaging an existing cascade display rack.
Figure 14:
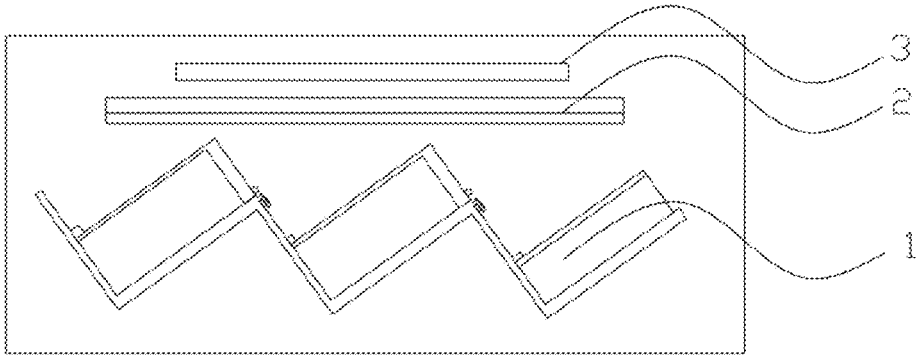
FIG. 14 is a structural diagram showing space required for packaging the cascade display rack according to an embodiment of the present invention.

With reference to FIGS. 11-14, FIG. 11 is a perspective diagram showing the cascade display rack being packaged as provided in an embodiment of the present invention, FIG. 12 is a perspective diagram showing a cushioning part as provided in an embodiment of the present invention, FIG. 13 is a diagram showing required space for packaging an existing display rack and FIG. 14 is a diagram showing space required for packaging the cascade display rack as provided in an embodiment of the present invention.

As shown in FIG. 11-14, as an example, for display racks of the same size, using cushioning layers of the same thickness, and being packaged integrally as is done in the prior art, with the technical solution in the present invention, the packaged volume during transportation can be reduced for 20-30%;

It shall be noted that, in the other prior art, the display rack can be disassembled to be plates, and plates are connected detachably via screws, so that during transportation, the volume is reduced for over 50%; however, for this method, the installation is troublesome, a lot of connection parts are to be used, and it is difficult to promise good visual appearance of the display rack after installation.

Figure 5:
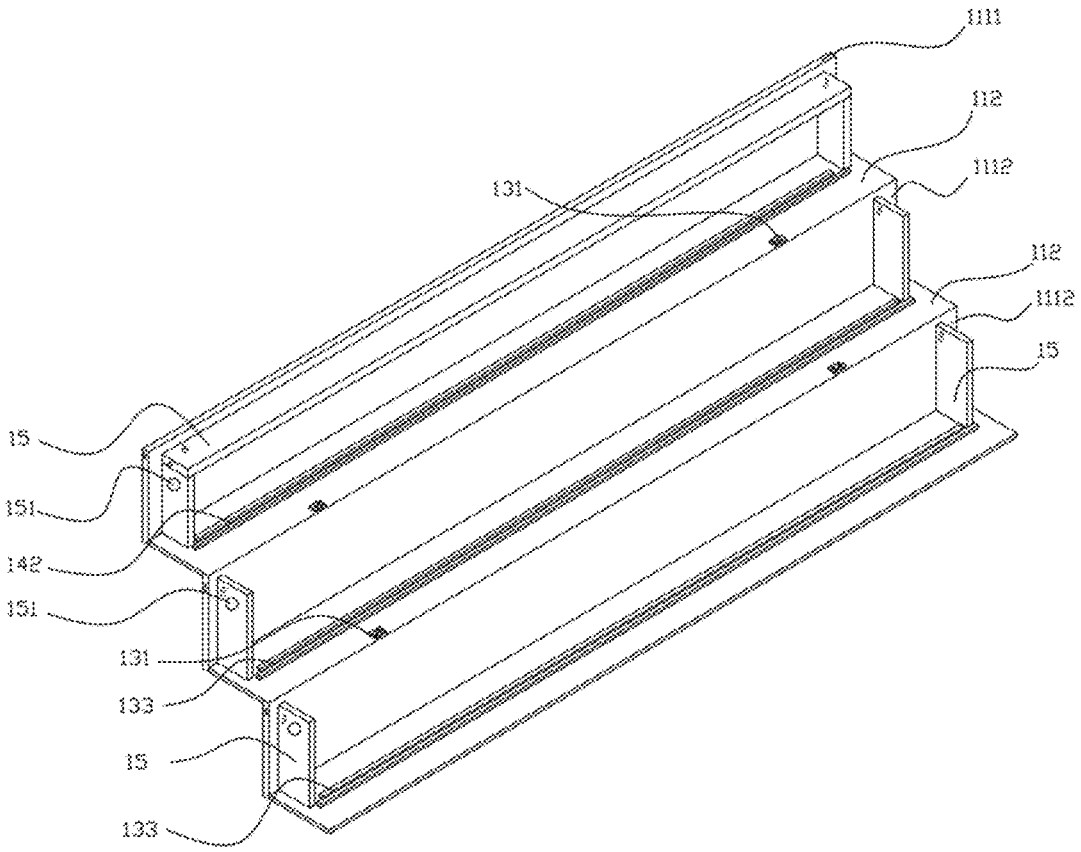
FIG. 5 is a structural perspective diagram showing combination of a plurality of cascade plates and a plurality of erecting panels of the cascade display rack according to an embodiment of the present invention.
Figure 6:
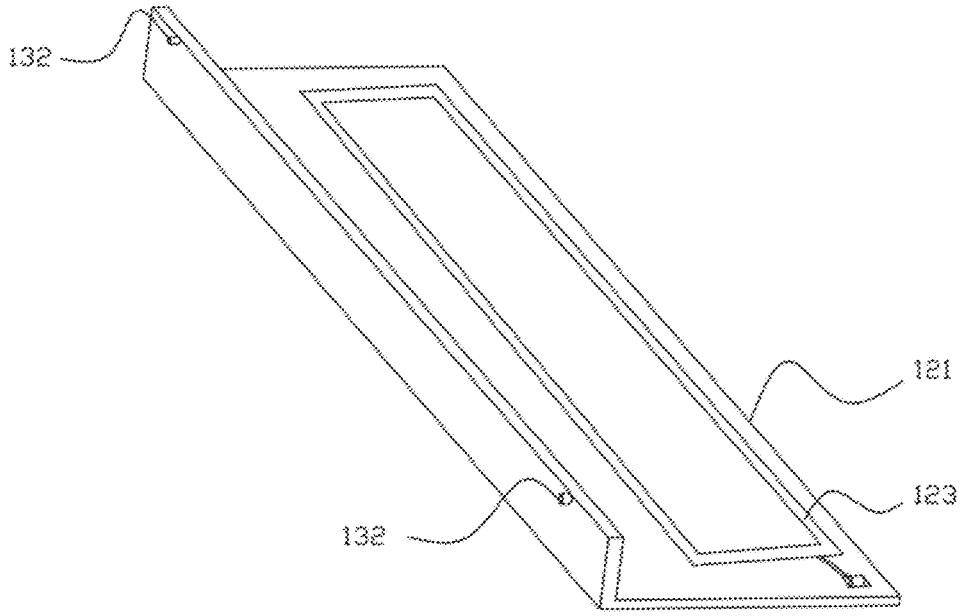
FIG. 6 is a structural perspective diagram showing a plurality of light band plates of the cascade display rack according to an embodiment of the present invention.
Figure 7:
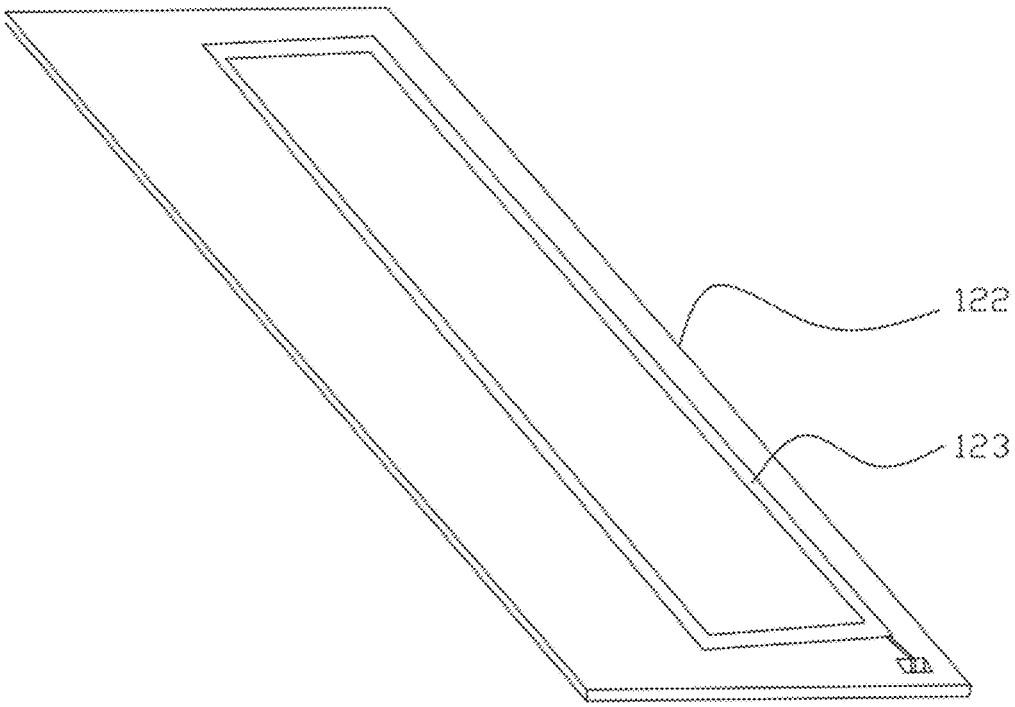
FIG. 7 is a structural perspective diagram showing a top-layer light band plate of the cascade display rack according to an embodiment of the present invention.

With reference to FIGS. 5-7, wherein FIG. 5 is a perspective diagram showing the cascade plates and the erecting panels being connected as provided in an embodiment of the present invention, FIG. 6 is a perspective diagram showing cascade light band plates of the cascade display rack as provided in an embodiment of the present invention, and FIG. 7 is a perspective diagram showing a top-layer light band plate of the cascade display rack as provided in an embodiment of the present invention.

As shown in FIGS. 5-7, in an embodiment, the supporting plates 111 and the vertical plates 112 are fabricated in batch, and the supporting plates 111 and the vertical plates 112 are alternately connected, so that the supporting plates 111 and the vertical plates 112 form the cascade plates 11; in this way, the cascade plate 11 in the first assembly 1 with many components can be made in advance in a workshop, and the manufacturing precision and structural strength of the cascade plates 11 can be promised.

In an embodiment, the supporting plates 111 and the vertical plates 112 are made of acrylic materials, and the supporting plates 111 and the vertical plates 112 can be glued and fixed together, so as to promise the connection strength in between the supporting plates 111 and the vertical plates 112 without influencing the appearance of the cascade plates 11.

In an embodiment, a first engagement assembly is provided on the cascade plates 11, the first engagement assembly is configured to install the light band plates 12; and at least one first engagement bulge is provided on the light band plates 12;

The first engagement assembly comprises at least one limiting groove, and at least one first buckle spaced apart from the at least one first limiting groove;

The at least one first buckle is configured to be connected with the at least one first engagement bulge on the light band plates 12, and the at least one first limiting groove is configured to house edges of the light band plates 12 away from the first engagement bulge.

By installing the light band plates 12 with the first engagement assembly, the assembly difficult of the light band plates 12 is reduced significantly, and the light band plates 12 are portable and assembly thereof is convenient. In the meanwhile, upon completion of installation of the display rack, the light band plates 12 are located inside the display rack, are not liable to be shocked by external forces or bear high loads, therefore, with the first engagement assembly sufficient supporting strength can be provided to promise stability of the light band plates 12 after installation.

It shall be noted that, the first engagement assembly for different light band plates 12 can be the same structure, or different structures. For example, in the following paragraphs, the cascade light band plates 121 and the top-layer light band plate 122 are detachably fixed on the cascade plates 11 via engagement assemblies of different structures.

In an embodiment, a length of the at least one first limiting groove is ⅔ times a length of the light band plates 12; when the length of the light band plates 12 are too high, the light band plates 12 may bend due to gravity thereof, therefore, when the length of the at least one first limiting groove is bigger, supporting to the edges of the light band plates 12 is bigger, the light band plates 12 are not liable to be suspended, and installation stability of the light band plates 12 is promised.

In an embodiment, the light band plates 12 comprise cascading light band plates 121 and a top-layer light band plate 122; the supporting plates 111 comprise a top-layer supporting plate 1111 and non-top-layer supporting plates 1112;

The top-layer light band plate 122 is configured to be a first light reflective plate, and is provided opposite to the top-layer supporting plate 1111 of the cascade plates 11, and at least one light reflective film and at least one light band 123 are provided on a surface of the first light reflective plate orienting to the top-layer supporting plate 1111;

The cascade light band plates 121 comprise vertically connected second light reflective plates and connection plates, the cascade light band plates 121 work with the non-top-layer supporting plates 1112 to be light emitting space, and at least one light reflective film and at least one light band 123 are provided on a surface of the at least one second light reflective plate orienting to the non-top-layer supporting plates 1112. After installation of the display rack, the top-layer light band plate 122 can engage with the back panel 21 and the cascade plates 11 to be light emitting space, providing light sources on the top-layer supporting plate 1111 of the cascade plates 11, decoration effects of the display rack are improved.

In an embodiment, the light bands 123 are arranged in a loop on the light band plates 12, and through-holes for wiring the light bands 123 are provided on the light band plates 12; in this way, light can be uniformly given to the supporting plates 112 and the decoration effects of the display rack can be enhanced.

In an embodiment, the at least one second light reflective plate and the connection plates are arranged in a shaped of L, and the connection plates are made of light screen plates, so that a rectangular light emitting space is formed by engagement of the non-top-layer supporting plates 1112 on the cascade plates 11 and the vertical plates 112 of the cascade light band plates 121, so as to provide a light source for the non-top-layer supporting plates 1112 and improve the decoration effects of the display rack.

In an embodiment, the light emitting space formed by the top-layer light band plate 122 has the same size as the light emitting space formed by the cascade light band plates 121; in this way, the light sources generated in different light emitting spaces can be uniform and homogeneous, and it is easier to control changes of the light source strengths in different light emitting spaces. The light sources can be given to the supporting plates 1112 fully and evenly, the supporting plates 1112 can emit even lights to further improve decoration effects of the display rack.

In an embodiment, at least one limiting groove is provided on the cascade plates 11, at least one limiting block corresponding to the at least one limiting groove is provided on the back panel of the second assembly 2;

The at least one limiting groove and the at least one limiting block are configured to support the top-layer light band plate 122;

A second engagement assembly 13 is provided on the cascade plates 11, the second engagement assembly 13 comprises at least one second limiting groove 133, and at least one second buckle 131 spaced apart from the at least one limiting groove 133;

At least one second engagement bulge 132 for engaging with the at least one second buckle 131 are provided on the connection plates of the light band plates 121;

The at least one second buckle 131 is connected with the at least one second engagement bugle 132, the at least one second limiting groove 133 houses edges of the non-top-layer light band plates 122 away from the at least one second engagement bugle 132 to support the cascade light band plates 121.

In an embodiment, the at least one second buckle 131 is rotatably provided on the cascade plates 11, when the connection plates of the cascade light band plates 121 are installed on the cascade plates 11, the at least one second engagement bugle 132 corresponds to the at least one second buckle 131, by rotating the at least one second buckle 131 the at least one second buckle 131 can be connected with the at least one second engagement bugle 132, so as to fix quickly the cascade light band plates 121; otherwise, by rotating the at least one second buckle 131 the at least one second buckle 131 can be disconnected from the at least one second engagement bugle 132 to realize quick disassembly of the cascade light band plates 121.

In an embodiment, the top-layer light band plate 122 is planar, the at least one limiting groove and the at least one limiting block support respectively edges of the top-layer light band plate 122; so that the top-layer light band plate 122 is supported stably and reliably.

In an embodiment, a length of the at least one limiting groove is bigger than ⅔ of a length of the top-layer light band plate 122; the at least one limiting block is provided at an intermediate portion of the top-layer light band plate 122, to provide stable and reliable support and limit on the top-layer light band plate 122.

In an embodiment, the first engagement assembly and the second engagement assembly 13 can be the same structure.

In an embodiment, the present invention further comprises an energizing circuit, the energizing circuit comprise a plurality of ports, controllers and power supply interfaces; the ports are connected with power supply plugs of the light bands 123.

The energizing circuit can be detachable from the light bands 123, when light is required, connecting the energizing circuit to the light bands 123 on the light band plates 12 so as to supply power and control the light bands 123; when light is not required, the energizing circuit can be not connected so as to improve flexibility of the product during use.

On the other aspect, the energizing circuit can be individually disposed during transportation so as to avoid falling off of the light bands from the light band plates or damage of the light bands during transportation of the display rack, and provide transportation safety and reliability.

Figure 8:
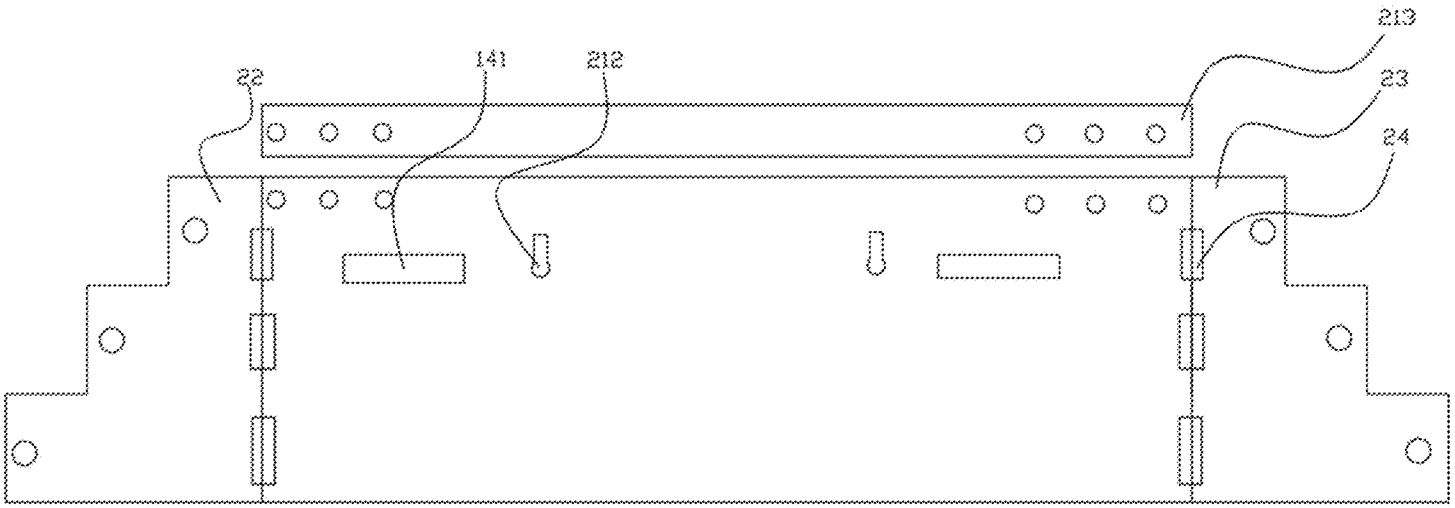
FIG. 8 is a structural perspective diagram showing a decomposed second assembly of the cascade display rack according to an embodiment of the present invention.
Figure 9:
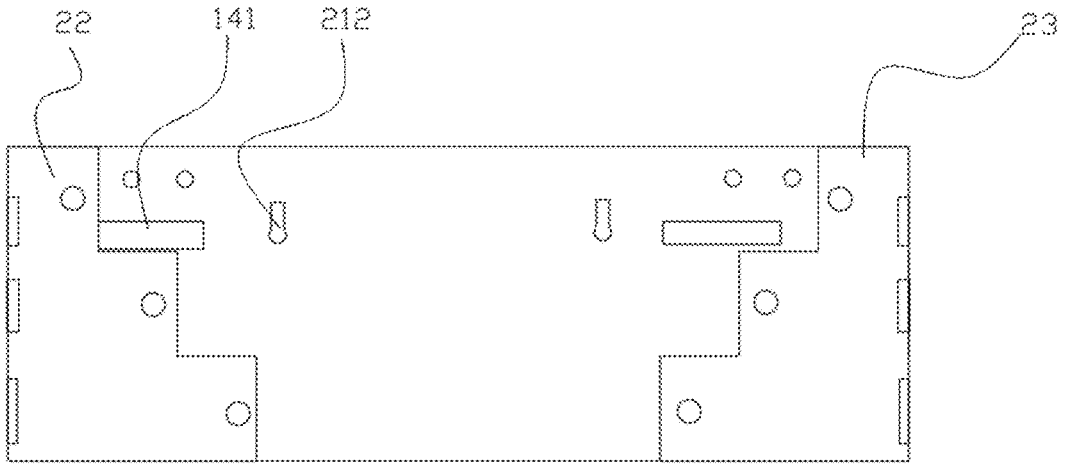
FIG. 9 is a top view of the second assembly being folded of the cascade display rack according to an embodiment of the present invention.
Figure 10:
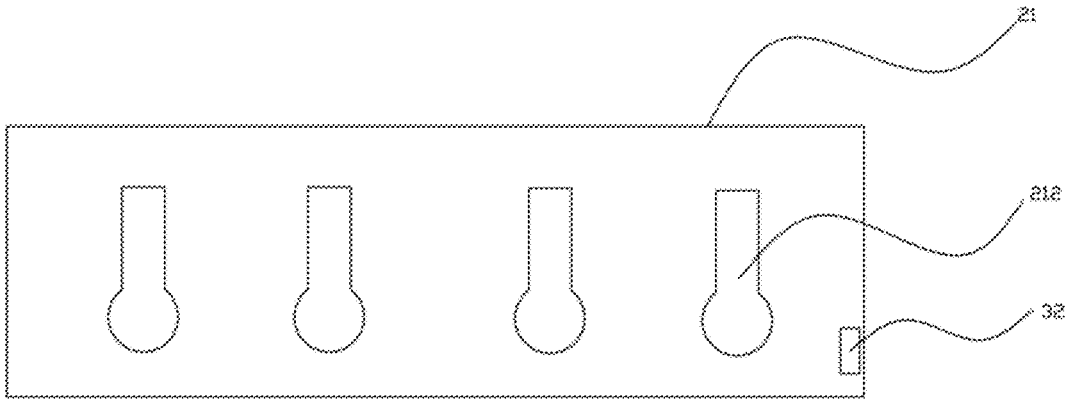
FIG. 10 is a top view of a bottom panel of the cascade display rack according to an embodiment of the present invention.
Figure 11:
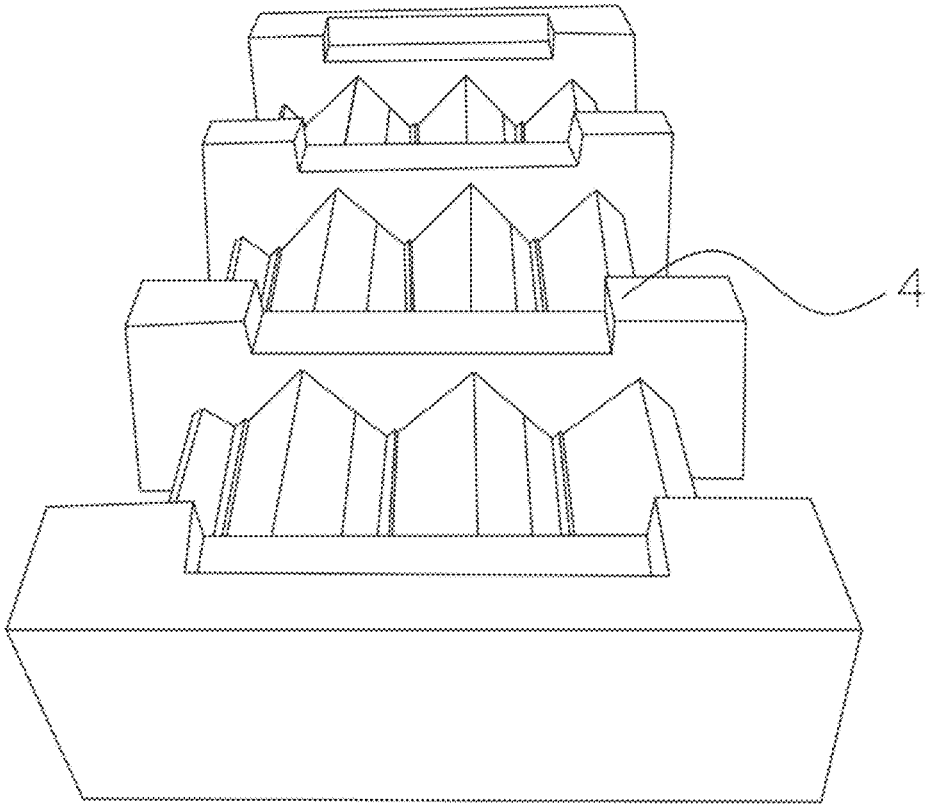
FIG. 11 is a structural perspective diagram showing the cascade display rack being packaged according to an embodiment of the present invention.

With reference to FIGS. 8 and 9, FIG. 8 shows a decomposed second assembly of the cascade display rack as provided in an embodiment of the present invention and FIG. 9 is a top view of the second assembly being folded in the cascade display rack as provided in an embodiment of the present invention.

Figure 4:
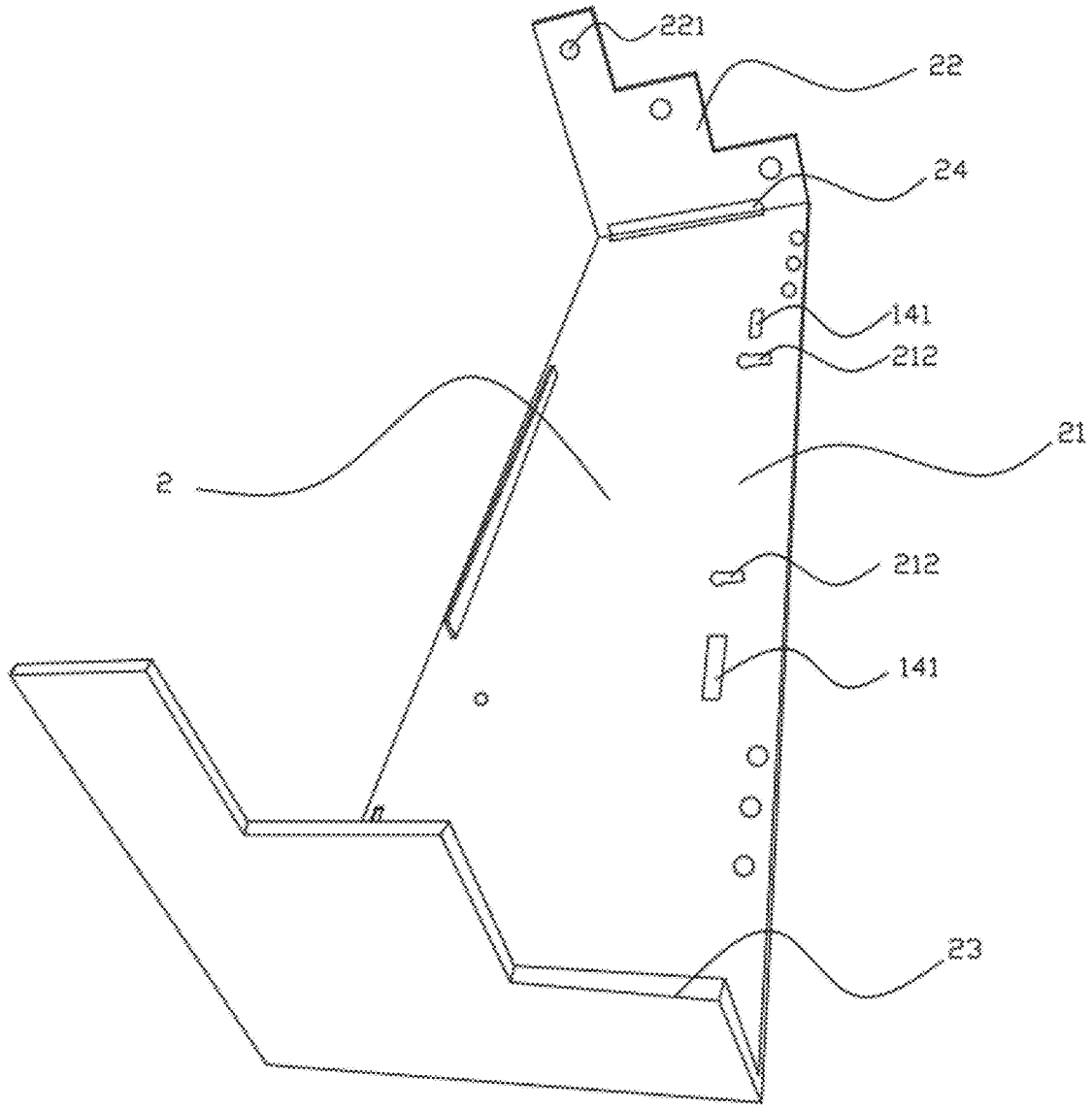
FIG. 4 is a structural perspective diagram showing a second assembly of the cascade display rack according to an embodiment of the present invention.

As shown in FIGS. 8-9, and in conjunction with FIGS. 3-5, in an embodiment, at least one first connection region 16 and at least one second connection region 17 are provided at both ends of the cascade plates 11;

The erecting panels 15 are vertically provided at both ends of the cascade plates 11, and installation positions of the erecting panels 15 are in connection with edges of the at least one first connection region 16 and the at least one second connection region 17;

At least one positioning hole 151 is provided in the erecting panels 15;

At least one limiting part corresponding to the at least one positioning hole 151 in the erecting panels 15 is provided on the first side panel 22 and the second side panel 23.

The first side panel 22 and the second side panel 23 are connected with the at least one positioning hole 151 in the erecting panels 15, so that some of edges of the first side panel 22 are connected with the at least one first connection region 16, and some of edges of the second side panel 23 are connected with the at least one second connection region 17 on the cascade plates 11.

In an embodiment, a width of the first connection region 16 and the second connection region 17 is the same as a thickness of the first side panel 22 and the second side panel 23, so that after the first side panel 22 and the second side panel 23 are installed on the at least one first connection region 16 and the at least one second connection region 17, outer surfaces of the first side panel 22 and the second side panel 23 are located at the same level as a side of the cascade plates 11 and the visual pleasantness of the display rack is improved.

In an embodiment, the erecting panels 15 are attached to the first side panel 22 and the second side panel 23, on one aspect, the erecting panels 15 can be fixed on the first side panel 22 and the second side panel 23; on the other aspect, the erecting panels 15 serve to limit the first side panel 22 and the second side panel 23 in the at least one first connection region 16 and the at least one second connection region 17.

In an embodiment, the at least one limiting part comprises a non-return buckle 221; during installation, orienting the at least one limiting part on the first side panel 22 to the at least one positioning hole 151 in the erecting panels 15, fitting the at least one limiting part in the at least one positioning hole 151 installation of the first side panel 22 and the erecting panels 15 is completed, similarly, installation of the second side panel 23 and the erecting panels 15 can be done.

In other alternative embodiments, fixing between the first side panel 22 and the second side panel 23 and the erecting panels 15 can be done in other ways, for example, connecting with fastening tapes or glues.

It shall be noted that, as after the first side panel 22 and the second side panel 23 are installed on the erecting panels 15, during use of the display rack, the first side panel 22 and the second side panel 23 are mainly used to support the supporting plates 111 and the vertical plates 112 in the cascade plates 11, connection between the first side panel 22 and the second side panel 23 and the erecting panels 15 is required to be in small connection strength, on this basis, any quick installation ways can be used. In other alternative embodiments, to increase connection strength between the first side panel 22, the second side panel 23 and the erecting panels 15, connection via screws and nuts can be used, for example, the at least one limiting part is configured to between adaptive screws and nuts, by extending the screws into the at least one positioning hole in the erecting panels 15, locking the screws with the nuts, the at least one limiting part can be fixed on the erecting panels 15.

In an embodiment, edges of the erecting panels 15 do not go beyond a thickness of the cascade plates 11 extending in a vertical direction; so that when packing the cascade plates 1, configuration of the erecting panels 15 will not increase a height of the cascade plates 11 vertical to an extension direction, so as to avoid increase of the volume to the greatest extent.

In an embodiment, the erecting panels 15 comprise square panels, or triangular panels; specifically, the present invention does not restrict on this.

In an embodiment, at least one fixing plate 213 is provided at a top region of the back panel 21 of the second assembly 2, the at least one fixing plate 213 passes fixing holes in the back panel 21;

Hanging holes 212 are provided underneath the at least one fixing plate 213;

The first side panel 22 and the second side panel 23 are rotatably connected with the back panel 21 via at least one hinge, and a rotation range of the first side panel 22 and the second side panel 23 relative to the back panel 21 is 0-95°.

In a case, by installing connection parts such as expansion bolts, fixing nails in the fixing holes, the back panel 21 can be fixed on a wall or other external object. In the meanwhile, by providing the at least one fixing plate 213 on a top portion of the back panel 21 the structural strength of the back panel 21 and loading strength of the connection regions can be improved. In this way, stability and reliability of the display rack on the wall can be promised.

In a case, with the hanging holes 212 underneath the fixing plate 213, the back panel 21 can be hung on installation nails or blocks on a wall so as to install or detach the display rack and improve the use flexibility of the display rack.

In an embodiment, a rotation range of the first side panel 22 and the second side panel 23 relative to the back panel 21 is 0-90°; at this time, when the first side panel 22 and the second side panel 23 are fully extended, they are perpendicular to the back panel 21, in the meanwhile, as the first side panel 22 and the second side panel 23 are bendable, the first side panel 22 and the second side panel 23 can be rotated for more than 90 degrees relative to the back panel 21, so as to install the at least one limiting part on the first side panel 22 and the second side panel 23 into the positioning holes 151 in the erecting panels 15.

In an embodiment, the present invention further comprises a bottom panel 3 covering the first assembly 1 and the second assembly 2;

Edges of the bottom panel 3 are connected with bottom edges of the first assembly 1 and the second assembly 2, and wiring holes 32 and glass suspension holes 31 are provided in the bottom panel 3.

On one aspect, the bottom panel 3 can be shaded to improve visual pleasantness of the display rack; on the other aspect, with the bottom panel 3 the structural strength of the display rack can be further improved, and supports can be formed at bottom edges of the display rack. In the meanwhile, the glass suspension holes 31 can be provided in the bottom panel for hanging the wine glasses, and usage conditions and universality of the display rack is improved.

Please refer to FIGS. 11-14 again, and as shown in FIGS. 11-14, before transporting the display rack, the display rack can be packed in the following manner:

a packaging method of the cascade display rack, comprising the cascade display rack set forth in any of the foregoing embodiments; and a plurality of cushioning pads;

Wherein the plurality of cushioning pads comprise end portion cushioning parts and intermediate cushioning parts;

Cascading grooves are provided in the end portion cushioning parts, first installation notches are provided at edges of the end portion cushioning parts surrounding the cascading grooves, and an extension direction of the first installation notches is parallel to an extension direction of the cascading grooves;

The cascading grooves and the cascading through-hole are configured to enclose the first assembly 1; the first installation notches and the second installation notches are configured to place the second assembly 2 when folded;

Wherein the packaging steps comprise:

S11: fitting the intermediate cushioning parts in the first assembly;

S12: connecting the end portion cushioning parts at both ends of the first assembly;

S13: placing the folded second assembly in between the first installation notches and the second installation notches;

S14: covering the second assembly with the cushioning pads;

S15: encasing to complete packaging and forming a part ready for transportation.

In an embodiment, the light band plates 12 in the first assembly 1 can be attached to the cascade plates 11, so as to have the light band plates 12 to extend within a thickness of the cascade plates 11 and perpendicular to an extension direction of the cascade plates 11, and avoid to increase the packaged volume of the first assembly 1.

In other alternative embodiments, the light band plates 12 in the first assembly 1 can be installed on the cascade plates 11 in advance and be fixed with fixing parts such as glues; with this method, steps required for assembly of the product after transportation can be further reduced and usage experience upon receipt is improved.

It shall be noted that, the folded second assembly 2 has a strong shock resistance ability, therefore, when the second assembly 2 is configured in between the first installation notch and the second installation notch, thickness required for cushioning layers in between the second assembly 2 and the packaging box can be reduced, so as to reduce the volume of the entire package.

In an embodiment, inwardly concave housing space is provided sides of the end portion cushioning parts away from the cascading grooves and the housing space can be used to house wiring parts, installation parts, specifications etc., so as to place other parts without increasing the package size.

Upon receipt of the packaged display rack the following method can be employed to install the display rack.

an installation method of cascade display rack; wherein the installation steps comprise:

S21: removing the packaging box, and removing the plurality of cushioning pads;

S22: placing the plurality of cascade plates upside down, and installing the plurality of light band plates sequentially;

S23: expanding the first side panel and the second side panel in the second assembly, and fixing the first side panel and the second side panel on the plurality of erecting panels of the plurality of cascade plates;

S24: putting the display rack in position and completing installation.

With the foregoing technical solutions, quick installation of the display rack can be done, in the meanwhile, the erected display rack has sufficient structural strength to satisfy actual usage requirements.

With the foregoing installation method, compared with receiving the complete product in the existing technology, by increasing only two steps (installation steps S22 and S23) installation of the display rack can be completed.

In other alternative embodiments, when the light band plates 12 are directly installed on the cascade plates 11 for transportation, by increasing only one step (installation step S23) installation of the display rack can be completed.

In the meanwhile, the light band plates 12 can be joined together, so as to reduce complexity of installation of the light band plates and make the product to be portable.

Further, in the step S23, by expanding the first side panel 22 and the second side panel 23, and installing them on the erecting panels of the cascade plates 11 the installation of the first assembly 1 and the second assembly 2 can be completed, and as per actual usage conditions, the first assembly 1 and the second assembly 2 being joined together are sufficient for bearing ability of the display rack. While the connection strength is satisfied, the installation convenience is improved to the largest extent.

Finally it shall be noted that, the embodiments are only intended to explain rather than limiting the technical solutions of the present invention; although a detailed description is given to the present invention with reference to the foregoing embodiment, those of ordinary skill in the art shall understand that: it is still possible to modify the technical solutions recited in the foregoing embodiments, or make equivalent replacement to some or all technical features in the embodiments; and such modifications or replacement does not deviate the essence of the corresponding technical solutions from the scope of the embodiments of the present invention.

The invention claimed is:

1. A cascade display rack, comprising:

a first assembly, comprising a plurality of cascade plates forming a cascade, and a plurality of light band plate s detachably connected on the plurality of cascade plates;

the plurality of cascade plates comprise a plurality of supporting plates and a plurality of vertical plates, wherein the plurality of supporting plates and the plurality of vertical plates are alternately connected;

wherein the plurality of supporting plates comprise light-admitting plates, the plurality of vertical plates comprise light screen plates, and the plurality of light band plates are provided relative to the plurality of supporting plates;

a second assembly, comprising a back panel, and a first side panel and a second side panel rotatably provided at ends of the back panel;

a plurality of erecting panels are provided at ends of the plurality of cascade plates in the first assembly, the first side panel and the second side panel are fixable on the plurality of erecting panels to connect the first assembly and the second assembly.

2. The cascade display rack according to claim 1, wherein at least one first engagement assembly is provided on the plurality of cascade plates, and the at least one first engagement assembly is configured to install the plurality of light band plates; at least one first engagement bulge is provided on the plurality of light band plates;

the at least one first engagement assembly comprises at least one first limiting groove, and first buckles intermittently provided next to the at least one first limiting groove;

the first buckles are configured to be connected with the at least one first engagement bulge on the plurality of light band plates, and the at least one first limiting groove is configured to house edges of the plurality of light band plates away from the at least one first engagement bulge.

3. The cascade display rack according to claim 1, wherein the plurality of light band plates comprise a plurality of cascade light band plates and at least one top-layer light band plate; and the plurality of supporting plates comprise at least one top-layer supporting plate and at least one non-top-layer supporting plate;

the at least one top-layer supporting plate is configured to be at least one first light reflective plate, and is provided opposite to the at least one top-layer supporting plate of the plurality of cascade plates, and at least one light reflective film and at least one light band are provided at a surface of the at least one first light reflective plate orienting to the at least one top-layer supporting plate;

the plurality of cascade light band plates comprise at least one second light reflective plate and at least one connection plate vertically connected, a light reflective space is formed by engagement of the plurality of cascade light band plates and the corresponding at least one non-top-layer supporting plate, and a light reflective film and a light band are provided on a surface of the at least one second light reflective plate orienting to the at least one non-top-layer supporting plate.

4. The cascade display rack according to claim 3, wherein at least one limiting groove is provided in the plurality of cascade plates, and at least one limiting block for engaging with the at least one limiting groove is provided on the back panel of the second assembly;

the at least one limiting groove and the at least one limiting block are configured to support the top-layer light band plate;

at least one first engagement assembly is provided on the plurality of cascade plates, the at least one first engagement assembly comprises at least one second limiting groove, and at least one first engagement buckle provided at an interval from the at least one second limiting groove;

at least one first engagement bulge for engagement with the at least one first engagement buckle is provided on the at least one connection plate of the plurality of cascade light band plates;

the at least one first engagement buckle is connected with the at least one first engagement bulge, and the at least one second limiting groove is configured to house edges of sides of the at least one non-top-layer supporting plate opposite to the at least one second limiting groove to support the at least one non-top-layer supporting plate.

5. The cascade display rack according to claim 2, further comprises an energizing circuit, wherein the energizing circuit comprises a plurality of ports, controllers and power connectors sequentially connected;

wherein the plurality of ports are connected with power supply plugs of the plurality of light band plates.

6. The cascade display rack according to claim 1, wherein a first connection region and a second connection region are provided at both ends of the plurality of cascade plates;

the plurality of erecting panels are vertically provided at ends of the plurality of cascade plates, and erecting positions of the plurality of erecting panels are connected with edges of the first connection region and the second connection region;

at least one positioning hole is provided in the plurality of erecting panels;

at least one limiting part corresponding to the at least one positioning hole in the plurality of erecting panels is provided on the first side panel and the second side panel;

the first side panel and the second side panel are connected with the at least one positioning hole in the plurality of erecting panels via the at least one limiting part, so that some edges of the first side panel are connected with the first connection region of the plurality of cascade plates, and some edges of the second side panel are connected with the second connection region of the plurality of cascade plates.

7. The cascade display rack according to claim 1, wherein fixing plates are provided at a top portion of the back panel of the second assembly, wherein the fixing plates pass a plurality of fixing holes in the back panel;

a plurality of hanging holes are provided in the fixing plates;

both the first side panel and the second side panel are rotatably connected with the back panel via hinges, and rotation ranges of the first side panel and the second side panel relative to the back panel are 0-90°.

8. The cascade display rack according to claim 1, further comprises a bottom panel covering the first assembly and the second assembly;

edges of the bottom panel are connected with bottom edges of the first assembly and the second assembly, and wiring holes and a plurality of glass hanging holes are provided in the bottom panel.

9. A packaging method of the cascade display rack, comprising the cascade display rack set forth in claim 1; and a plurality of cushioning pads;

wherein the plurality of cushioning pads comprise end portion cushioning parts and intermediate cushioning parts;

cascading grooves are provided in the end portion cushioning parts, first installation notches are provided at edges of the end portion cushioning parts surrounding the cascading grooves, and an extension direction of the first installation notches is parallel to an extension direction of the cascading grooves;

cascading through-holes are provided in the intermediate cushioning parts, and second installation notches are provided along edges of the cascading through-holes in the intermediate cushioning parts;

the cascading grooves and the cascading through-holes are configured to enclose the first assembly; the first installation notches and the second installation notches are configured to place the second assembly when folded;

wherein packaging steps comprise:

S11: fitting the intermediate cushioning parts in the first assembly;

S12: connecting the end portion cushioning parts at ends of the first assembly;

S13: placing the folded second assembly in between the first installation notches and the second installation notches;

S14: covering the second assembly with the cushioning pads; and

S15: encasing to complete packaging and forming a part ready for transportation.

10. An installation method of the cascade display rack, comprising a packaged display rack ready for transportation packaged according to the method of claim 9;

wherein the installation steps comprise:

S21: removing a packaging box, and removing the plurality of cushioning pads;

S22: placing the plurality of cascade plates upside down, and installing the plurality of light band plates sequentially;

S23: expanding the first side panel and the second side panel in the second assembly, and fixing the first side panel and the second side panel on the plurality of erecting panels of the plurality of cascade plates; and S24: putting the display rack in position and completing installation.

* * * * *